US007798910B2

(12) United States Patent
Leadbetter et al.

(10) Patent No.: US 7,798,910 B2
(45) Date of Patent: Sep. 21, 2010

(54) GOLF SWING TRAINING DEVICE AND METHOD

(75) Inventors: David Leadbetter, Orlando, FL (US); F. Blaik Shew, Orlando, FL (US)

(73) Assignee: Swing King, LLC, Champions Gate, FL (US)

( * ) Notice: Subject to any disclaimer, the term of this patent is extended or adjusted under 35 U.S.C. 154(b) by 305 days.

(21) Appl. No.: 11/625,453

(22) Filed: Jan. 22, 2007

(65) Prior Publication Data

US 2007/0178986 A1 Aug. 2, 2007

Related U.S. Application Data

(60) Continuation-in-part of application No. 11/461,892, filed on Aug. 2, 2006, now Pat. No. 7,226,371, which is a division of application No. 10/850,342, filed on May 20, 2004, now Pat. No. 7,115,043.

(60) Provisional application No. 60/761,226, filed on Jan. 23, 2006, provisional application No. 60/472,711, filed on May 22, 2003, provisional application No. 60/476,256, filed on Jun. 5, 2003.

(51) Int. Cl.
*A63B 69/36* (2006.01)

(52) U.S. Cl. ..... 473/215; 473/207; 473/257; 473/266

(58) Field of Classification Search ..... 473/203–206, 473/219, 220–226, 231–234, 256, 257, 266
See application file for complete search history.

(56) References Cited

U.S. PATENT DOCUMENTS

| | | | | |
|---|---|---|---|---|
| 715,225 | A | | 12/1902 | Whitner |
| 1,075,054 | A | | 10/1913 | Morley |
| 1,638,454 | A | | 8/1927 | Papin |
| 1,690,312 | A | | 11/1928 | Rosan |
| 2,088,008 | A | | 7/1937 | Link |
| 2,135,648 | A | | 11/1938 | Stumpf |
| D125,602 | S | | 3/1941 | Wheeler et al. |
| 2,388,463 | A | | 11/1945 | Benecke |
| 2,396,408 | A | | 3/1946 | Benecke |
| 2,628,100 | A | | 2/1953 | Beebe |
| 2,782,422 | A | | 2/1957 | Bencriscutto |
| 2,950,115 | A | | 8/1960 | Hurdzan |
| 2,962,288 | A | | 11/1960 | Lowden |
| 3,111,322 | A | | 11/1963 | English |
| 3,256,023 | A | | 6/1966 | Frazelle |
| 3,278,011 | A | * | 10/1966 | Viemeister ..... 206/457 |
| 3,428,325 | A | | 2/1969 | Atkinson |
| 3,572,706 | A | | 3/1971 | Schroder |
| 3,725,957 | A | | 4/1973 | Shotmeyer |
| 3,875,591 | A | | 4/1975 | Cantales |
| 4,025,077 | A | | 5/1977 | Thompson |

(Continued)

*Primary Examiner*—Nini Legesse
(74) *Attorney, Agent, or Firm*—Allen, Dyer, Doppelt, Milbrath & Gilchrist, P.A.

(57) ABSTRACT

A golf swing training aid includes a shaft having two sliding elements magnetically attached to fixed positions on the shaft. The sliding elements slide along the shaft from initially coupled positions to impact positions during a backswing and downswing movement simulating a golf swing for providing distinctive sounds at selected impact positions along the shaft to aid in setting the shaft when executing the backswing and lagging of the shaft during the downswing. Grip protrusions are biased against webs of the fingers for enhancing power generated during the swing.

19 Claims, 15 Drawing Sheets

U.S. PATENT DOCUMENTS 4,027,886 A 6/1977 Katsube
4,511,147 A 4/1985 Olsen
4,569,525 A 2/1986 Folger
4,665,565 A 5/1987 Odom
4,726,588 A * 2/1988 Caprio ..... 273/153 R
4,809,975 A 3/1989 Lee
4,836,544 A 6/1989 Lai
4,848,746 A 7/1989 Klink
4,981,297 A 1/1991 Foster
4,982,963 A 1/1991 Fazio et al.
5,042,811 A 8/1991 D'Amico
D326,493 S 5/1992 Perry
5,133,551 A 7/1992 Handy et al.
5,143,375 A 9/1992 Wilkins
5,163,685 A 11/1992 Rhodes
5,188,365 A 2/1993 Picard
5,228,695 A 7/1993 Meyer
5,284,464 A 2/1994 Lee, III et al.
5,299,802 A 4/1994 Bouchet-Lassale
5,310,188 A 5/1994 Hernberg
5,332,211 A 7/1994 Rife et al.
5,366,218 A 11/1994 Gong
5,381,614 A 1/1995 Goldstein
5,398,930 A 3/1995 Gibson
5,403,008 A 4/1995 Mainiero
5,415,406 A 5/1995 Reichenbach et al.
D365,131 S 12/1995 Edwards et al.
5,487,546 A 1/1996 Yasuda
5,524,892 A 6/1996 Karp
5,527,039 A 6/1996 Levesque
5,542,126 A 8/1996 Harvanek
5,588,651 A 12/1996 Frost
5,588,653 A 12/1996 Robinson
D378,467 S 3/1997 Leadbetter
5,658,205 A 8/1997 Bartscherer
5,665,007 A 9/1997 Tatum
5,672,117 A 9/1997 Dar
5,704,065 A 1/1998 Feuerhake
5,711,718 A 1/1998 Mueller
5,729,864 A 3/1998 Lie et al.
D395,477 S 6/1998 Vela
5,762,563 A 6/1998 Holzhausen
5,769,734 A 6/1998 Qualey, Sr.
5,776,006 A 7/1998 Gruber
5,851,156 A 12/1998 Schwark, Jr.
5,893,803 A 4/1999 Leadbetter et al.
5,897,440 A 4/1999 Bae et al.
D416,597 S 11/1999 Grove et al.
5,984,795 A 11/1999 Stafford
6,001,025 A 12/1999 Blackmon
6,110,054 A 8/2000 Rodarte
6,132,322 A 10/2000 Bonham
6,231,453 B1 5/2001 Jebe
6,238,299 B1 5/2001 Barnette
6,270,430 B1 8/2001 Nicoloff
6,293,875 B1 9/2001 Sanford
D449,360 S 10/2001 Kallassy
D455,843 S 4/2002 Albany et al.
6,363,535 B1 4/2002 Landis
6,440,005 B1 8/2002 Hubenig
6,461,163 B1 10/2002 Gallagher et al.
6,464,597 B1 10/2002 Hardesty
6,475,098 B1 11/2002 Nemeckay
6,500,074 B1 12/2002 Thacker
6,503,149 B2 1/2003 Jelinek
6,599,200 B1 7/2003 Kallassy
6,955,610 B1 * 10/2005 Czaja et al. ..... 473/256
2001/0027136 A1 10/2001 Chris
2002/0072041 A1 6/2002 Gallagher et al.
2002/0094879 A1 7/2002 Dawson
2002/0132678 A1 9/2002 Matzie
2002/0151373 A1 10/2002 Beauregard
2002/0160846 A1 10/2002 Spitzer
2003/0144070 A1 7/2003 Kallassy
2003/0207717 A1 11/2003 Ulrich
2003/0207719 A1 11/2003 Hughes
2003/0211900 A1 11/2003 Novak et al.
2003/0224867 A1 12/2003 Ota
2004/0009826 A1 1/2004 Aisenberg
2004/0018885 A1 1/2004 Gulan et al.
2004/0023726 A1 2/2004 Ritson et al.
2004/0036194 A1 2/2004 Chadwick et al.
2004/0043828 A1 3/2004 Goldfader

* cited by examiner

GOLF SWING TRAINING DEVICE AND METHOD

CROSS REFERENCE TO RELATED APPLICATIONS

This application claims priority to and the benefit of Provisional application Ser. No. 60/761,226 filed on Jan. 23, 2006 for "Golf Swing Training Device and Method," and is a Continuation-In-Part application of application Ser. No. 11/461,892 filed on Aug. 2, 2006 for "Golf Swing Training Method," which itself is a Divisional application of application Ser. No. 10/850,342 having filing date May 20, 2004 for "Golf Swing Training Device and Method," which itself claims priority to Provisional applications having Ser. No. 60/472,711 and filing date May 22, 2003 for "Golf Grip Training Device and Method," and Ser. No. 60/476,256 and filing date Jun. 5, 2003 for "Golf Swing Training Device and Method," the disclosures of which are herein incorporated by reference in their entirety, and all commonly owned.

FIELD OF THE INVENTION

The invention generally relates to golf swing training, and more particularly to training synchronized golf swings through a desired gripping and positioning of a golf club.

BACKGROUND

Good golf begins with a good grip. As described in "The Golf Swing" The Stephen Green Press, 1990;"David Leadbetter's Faults and Fixes" Harper Collins Press, 1993; and "Positive Practice" Harper Collins Publishers, 1997, a good golf grip may not lead necessarily to a good swing, but a bad grip is much more likely to cause a bad golf swing. As is well accepted by those of ordinary skill in the art of the golf game, a good solid hold on the club is a first key step towards a correct positioning of the club head throughout the golf swing. Generally, a poor gripping of the club will place too much emphasis on the hands, and will lead to an over-controlling of the club and movement of the club head out of the preferred position for contacting the golf ball. In an athletic swing, the role of the hands is reduced as much as possible.

Many golfers position the golf club or grip in their hands in such a manner that makes it difficult to generate an optimum energy necessary to hit a golf ball their maximum distance. It is desirable that the golfer properly fit the top hand onto the grip. The top hand is the left hand for a right-handed swing, and typically the hand that wears a golf glove for improving the grip. The top hand represents an essential coupling of the golfer to the club. Unfortunately, what may look correct may actually conceal a poor grip. By way of example, it is desirable that the club be held primarily in the fingers of the bottom hand (the right hand for the right handed swing), and that the shaft of the club be diagonally positioned from the base of the little finger through the joints of the second and third fingers and on to the middle of the index finger. When the bottom hand is closed, the top hand thumb should be covered, fitting snugly beneath the fleshy pad at the base of the bottom hand thumb. Various grips have been developed in an effort to train a golfer to achieve a desirable gripping of the golf club and place the hands for a "proper" swinging of the club, such as described in U.S. Pat. Nos. 5,299,802 to Bouchet-Lassale and 5,984,795 to Stafford.

As those of skill in the art are well aware, details abound with respect to instructions for the "perfect swing." Further, the art is filled with devices and gimmicks for improving the golf swing to save but a few strokes during a round of golf. However, there remains a need to provide the feel for the proper fitting of the hands to the grip of the golf club, without attempting to clutter the mind with the intricate details of each anatomical element and its relation to the club.

There is further a need to aid the golfer in achieving a smooth flowing motion in the golf swing. By way of example, weighted golf clubs and training shafts have been used to improve the tempo and mechanics of the golf swing, as illustrated by way of example with reference to U.S. Pat. Nos. 2,388,463 to Benecke and 6,475,098 to Nemeckay for gold swing training devices. Sliding weights have also been used to aid in the timing of a "release" of the golf, such as the golf club attachment of U.S. Pat. Nos. 2,950,115 to Hurdzan and 4,027,886 to Katsube for improving the timing in a golf swing. Those of skill in the art understand that there is a distinction between hitting the ball and swinging through the ball requiring a synchronized movement of the golf club during the swing. The present invention provides a training device and method for achieving a desirable swing.

SUMMARY

The golf swing teaching device and method of the present invention provide, by way of example, a desirable method for "setting" the club and "hinging" the shaft when executing the backswing, an indication of a preferred "lagging" of the club during the forward swing, a correct method for providing preferred angle between shaft and arm, and may teach a desired release of the club head through the hitting area.

One embodiment of the present invention may include a grip carried on a tapered golf shaft with a fixed stop at the opposite end of the shaft from the grip. Two sliding elements are carried on the shaft. A friction barrier is carried on the shaft at a spaced relation to the fixed stop. The two sliding elements on the shaft make distinctive sounds during the swinging of the device in a training process. The two sliding elements may be slidably attached to the shaft at distinct tension levels to allow golfers with various skill levels and ages to develop their swing mechanics. The present invention further provides for a preferred gripping of the golf club. Embodiments of the present invention, as herein described by way of example, allow the golfer to hold the club in a position to cause the clubface to contact the golf ball during the swing for achieving the optimum energy transfer to the ball from the club head and provide a desirable golf ball trajectory.

One embodiment of the invention may include a golf swing training device comprising a grip having a plurality of protrusions outwardly extending therefrom and arranged for receiving multiple finger webs in guiding a hand of the user for gripping the shaft proximal end. Another embodiment may include a shaft defined by a proximal end portion, a distal end portion, and an intermediate portion, a first stop carried within the intermediate portion of the shaft, a second stop fixedly attached to the distal end portion of the shaft, a first element slidably carried by the shaft for movement from the proximal end portion of the shaft toward the first stop, wherein the first sliding element accelerates to the first stop for making contact therewith and creating a first sound thereby, and a second element slidably carried by the shaft for sliding movement from the intermediate portion toward the second stop, wherein the second element accelerates to the second stop for making contact therewith and creating a second sound thereby.

One embodiment of the swing training device may comprise an elongate shaft having a proximal portion, an opposing distal portion, and an intermediate portion therebetween, first and second magnetic elements carried at the proximal and the intermediate portions, respectively, each of the first and second magnetic elements having a fixed portion fixedly attached to the elongate shaft, a slidable portion for sliding movement along the shaft, a magnetic connection having a metal ring and a magnet carried by at least one of the slidable and fixed portions, wherein the sliding portion is magnetically coupled to the fixed portion prior to a swinging of the shaft and released therefrom by a centrifugal force exerted on the sliding portion during a swinging motion of the shaft, and a stop fixedly attached at the distal end of the shaft.

A method aspect of the invention includes a swing training method comprising holding a shaft by a user from a proximal end for a swinging thereof. The shaft includes a first sliding element releasably coupled to a first position on the shaft and a second sliding element releasably coupled to a second position on the shaft. The method may include swinging the shaft in a backswing movement away from the object for generating a first centrifugal force to release the first sliding element from the first position, wherein the first sliding element travels along the shaft to a first stop, making a first distinctive sound upon contacting the first stop, transitioning swinging the shaft from the backswing movement to a downswing movement, and swinging the shaft in a downswing movement toward the object for generating a second centrifugal force to release the second sliding element from the second position, wherein the second sliding element travels along the shaft to a second stop, making a second distinctive sound upon contacting the second stop.

BRIEF DESCRIPTION OF DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS

The present invention will now be described more fully with reference to the accompanying drawings in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
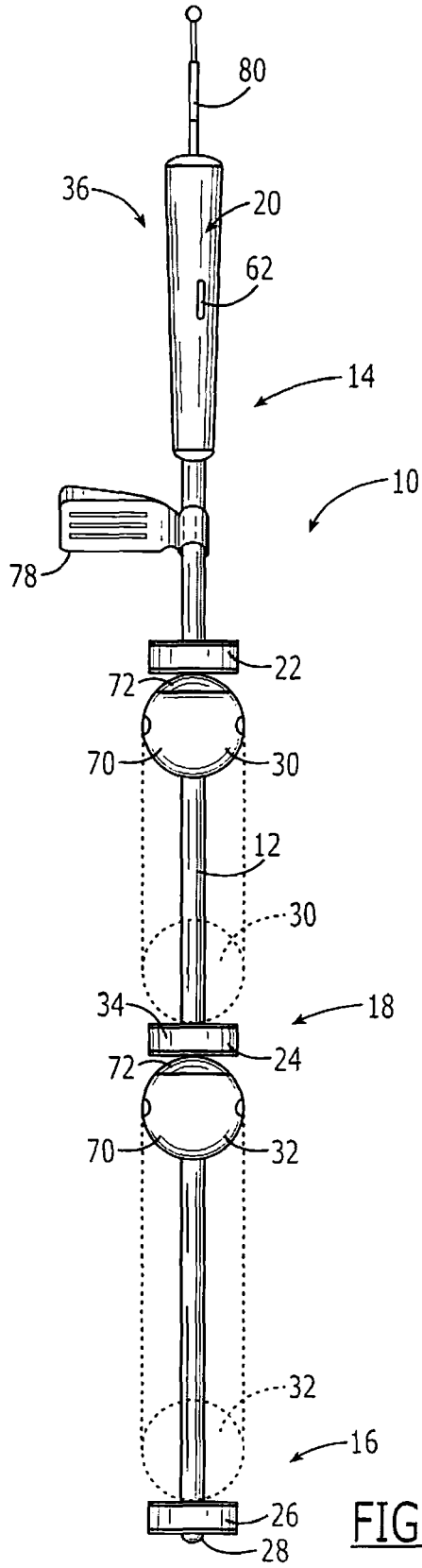
FIGS. 1 and 1A are plan views of alternate embodiments, herein described by way of example, for a swing training device is keeping with the teachings of the present invention.

With reference initially to FIG. 1, one embodiment of the includes a golf swing training device 10 having an elongate shaft 12 with a proximal end portion 14 for holding the device by a user, an opposing distal end portion 16, and an intermediate portion 18 therebetween. A grip 20 may be affixed at the proximal end portion 14. A first coupling 22 is affixed to the shaft 12 generally within the proximal end portion 14, but may be located as desired along the shaft length. A second coupling 24 is affixed the shaft 12 within the intermediate portion 18, by way of example for the embodiment herein described. A stop 26 is attached to the shaft 12 at the distal end portion 16, herein illustrated at an extreme end 28 of the shaft. The shaft 12 carries a first sliding element 30 for movement between the first coupling 22 and the second coupling 24, and a second sliding element 32 for movement between the second coupling 24 and the stop 26. The sliding elements 30, 32 have sufficient weight for responding to centrifugal forces during the swinging of the shaft 12 by a user when holding the grip 20 in simulating a golf swing.

With continued reference to FIG. 1, the first sliding element 30 is initially coupled to the first coupling 22 and the second sliding element 32 is coupled to the second coupling 24 prior to a swinging of the shaft in a training exercise. As will be further detailed later in this section, the first sliding element 30 is released from the first coupling 22 by a first centrifugal force generated by the swinging of the shaft 12 during a first swinging motion (known in golfing as a backswing). The first sliding element 30 accelerates toward the second coupling 24 and makes a first distinctive sound upon contact with a back surface 34 of the second coupling. The second sliding element 32, initially coupled to the second coupling 24, remains coupled during the backswing and is released during a second swinging motion (known in golfing as a downswing) by a second centrifugal force generated during the second swinging motion of the shaft 12. The second sliding element 32 accelerates toward the stop 26 and makes a second distinctive sound when contacting the stop. For the embodiment of the device 10, herein described with reference to FIG. 1, the shaft 12 comprises a circular cross section, and has a constant cross section along lengths of the shaft having the sliding element movements.

Figure 2:
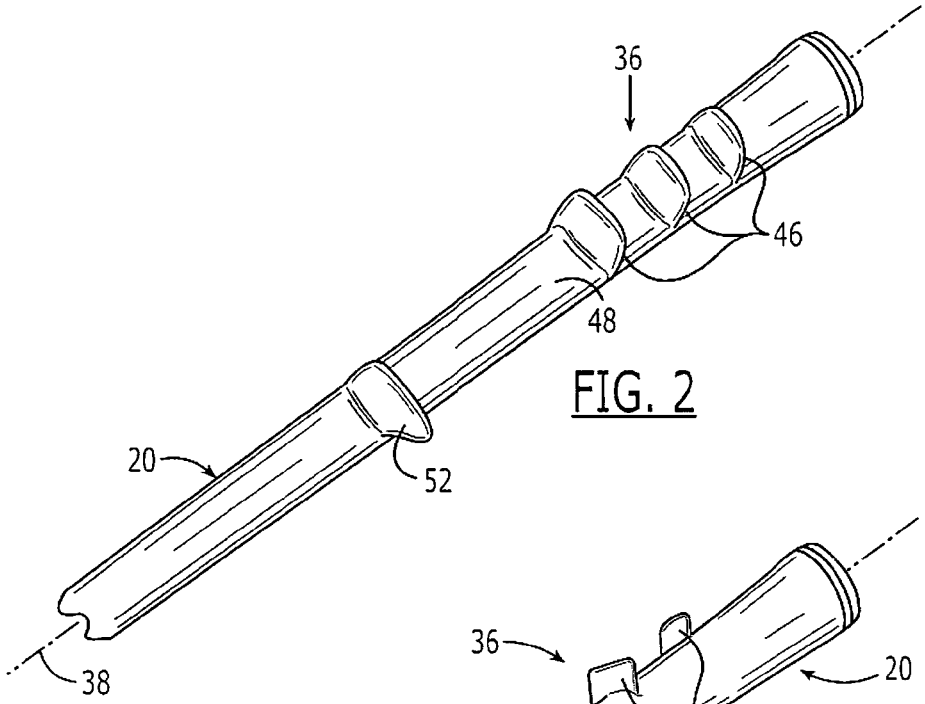
FIGS. 2 and 2A are bottom and side perspective views, respectively, of a grip useful with the devices of FIGS. 1 and 1A.
Figure 2A:
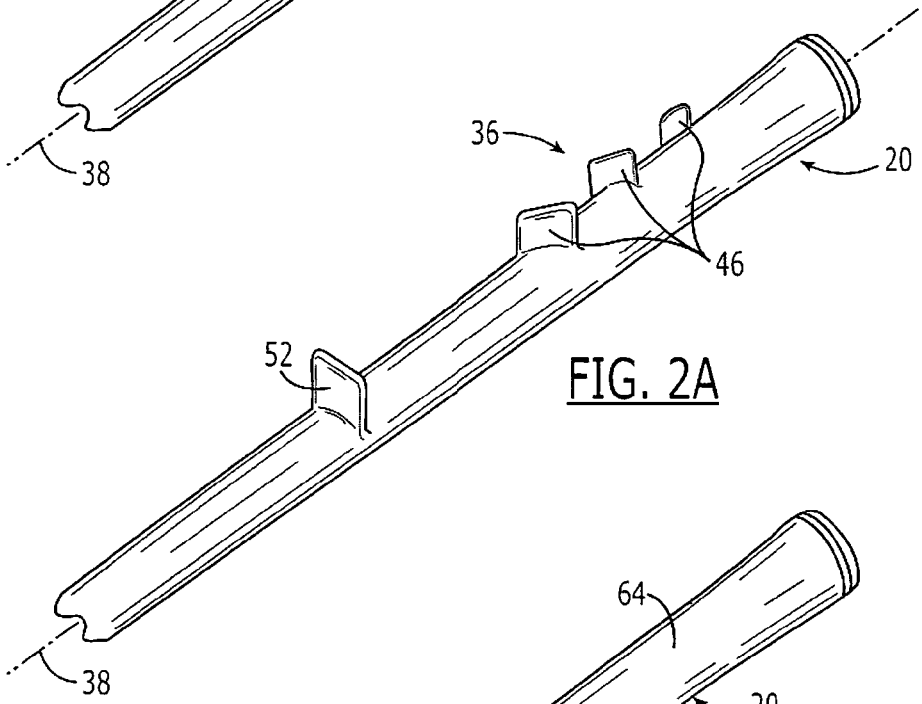
Figure 3:
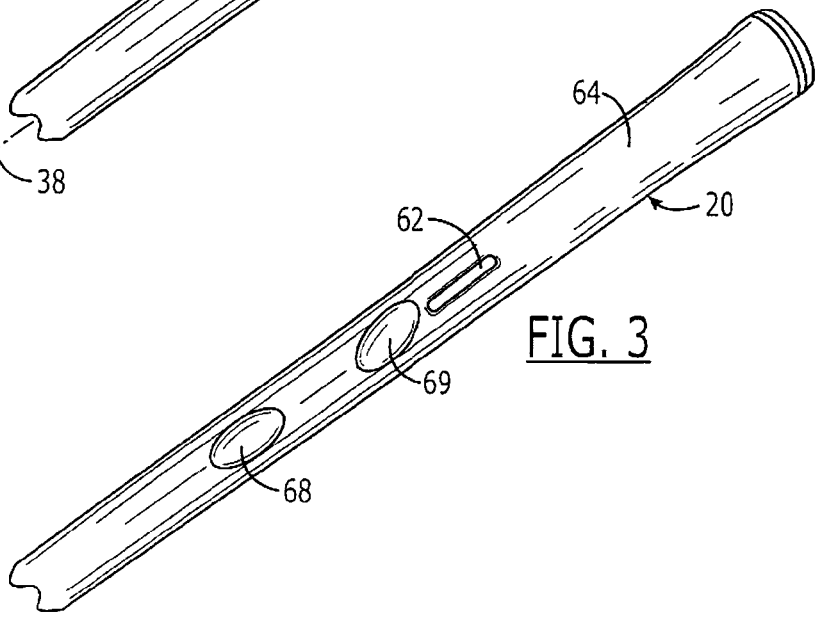
FIG. 3 is a top perspective view of the grip of FIG. 2.
Figure 4:
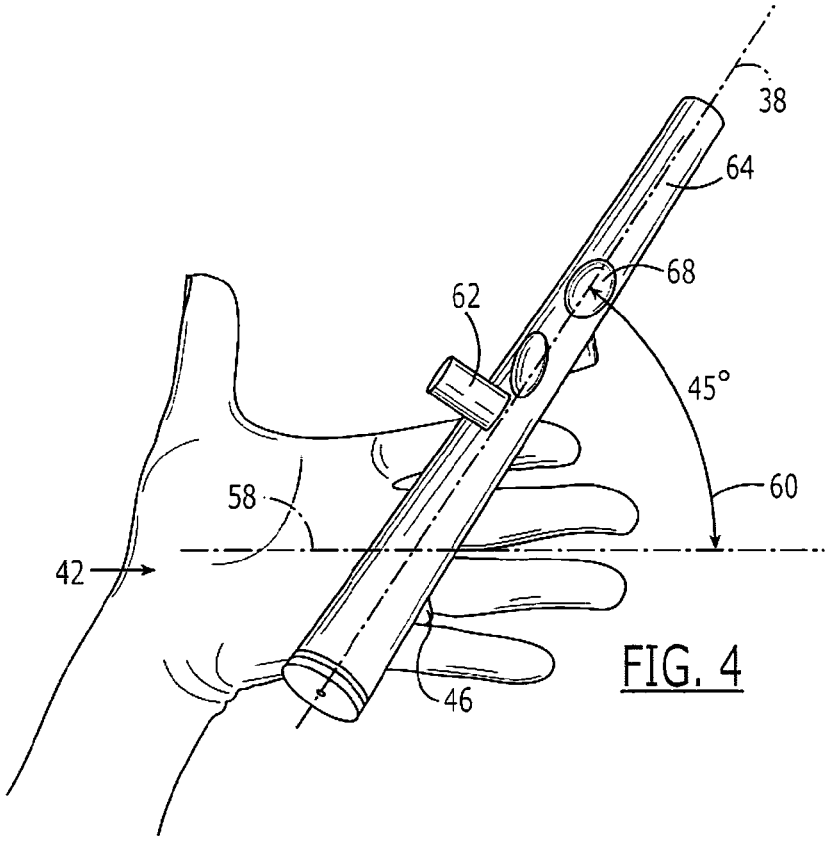
FIG. 4 is a partial side perspective view of the grip of FIG. 2 illustrating a placement of a top hand of a user carrying the grip within finger webs.
Figure 5:
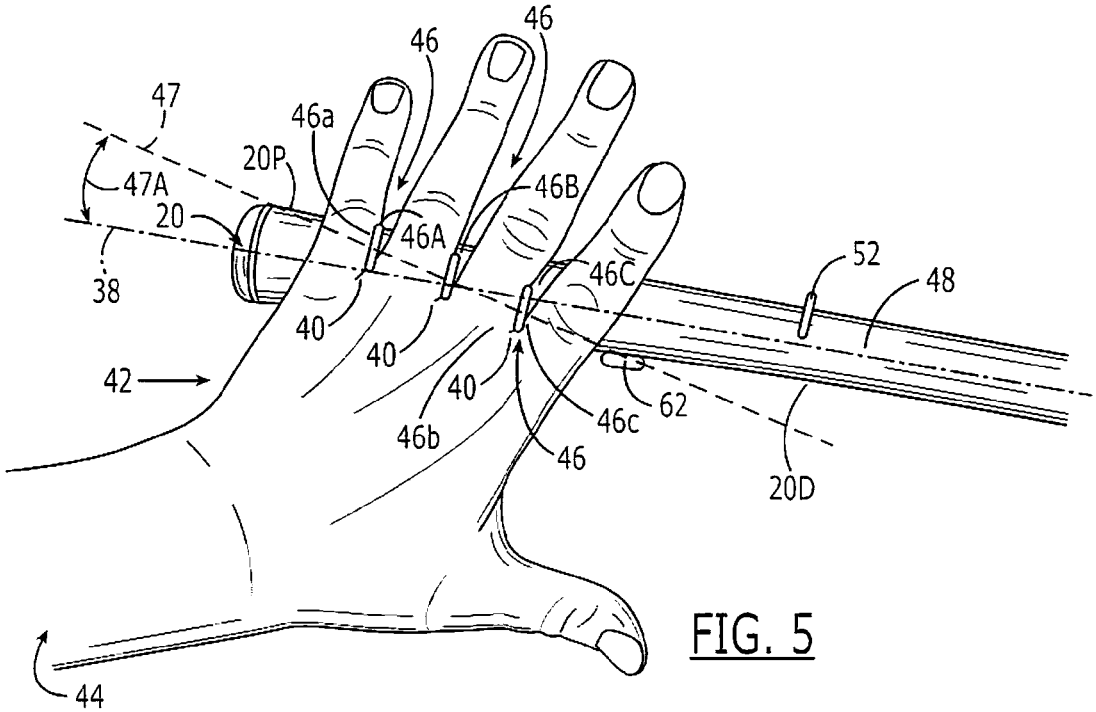
FIG. 5 is a plan view illustrating the placement of the top hand finger webs biased against protrusions on one embodiment of the grip, as illustrated in FIG. 4.
Figure 6:
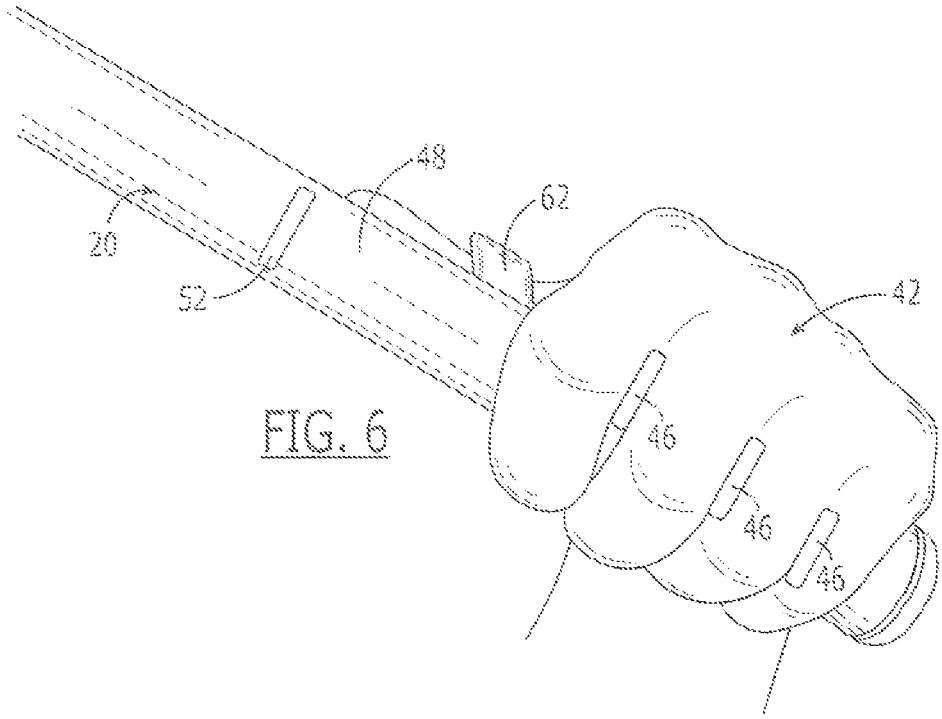
FIG. 6 is a perspective view of the top hand closed against the grip of FIG. 5.
Figure 8:
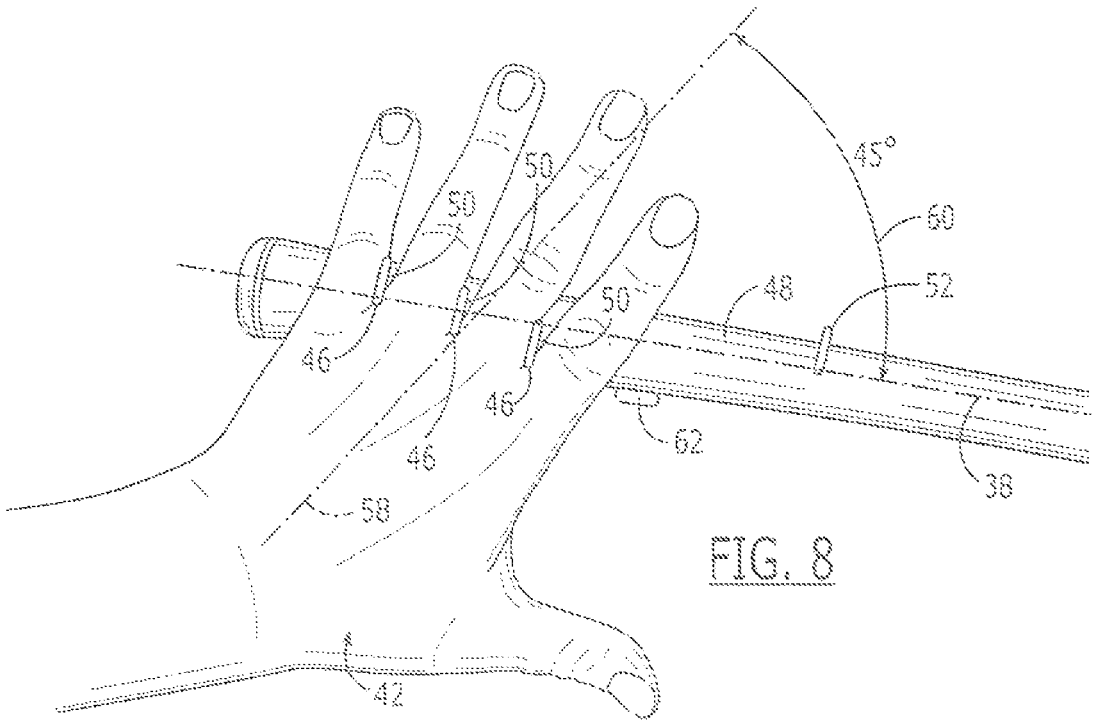
FIG. 8 is a plan view illustrating an angle between the grip of the top hand when webs of the fingers are biased against one embodiment of protrusions arranged on the grip.
Figure 7:
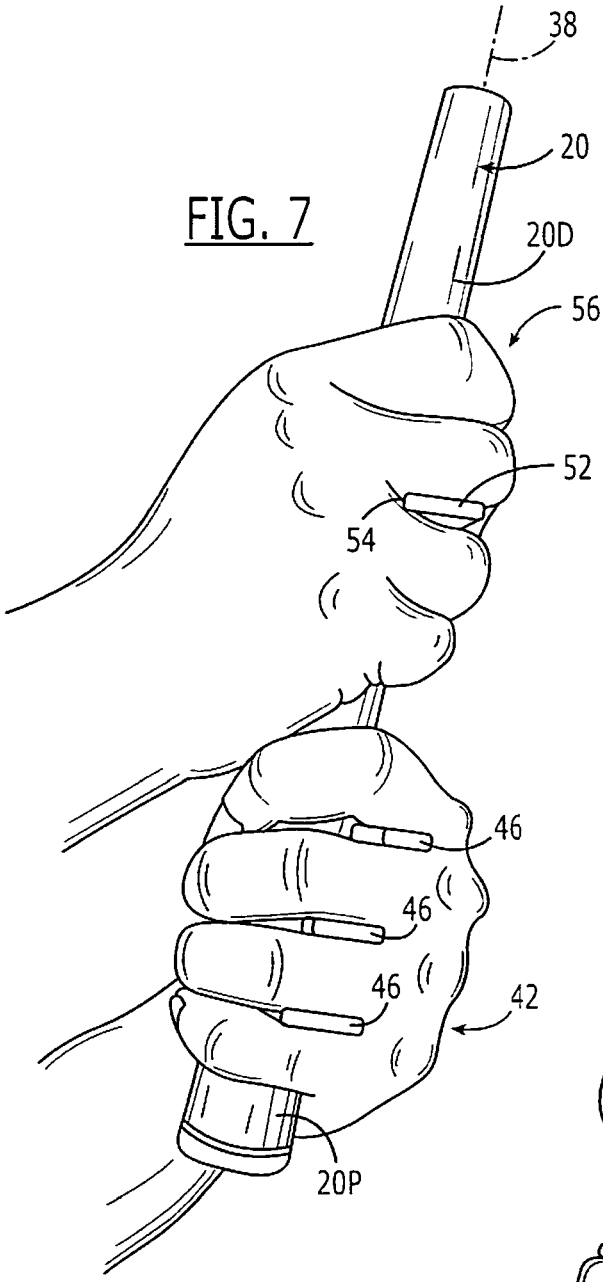
FIG. 7 is a perspective view of a baseball styled gripping of the grip of FIG. 5 illustrating top and bottom finger webs biased against protrusions carried by the grip.
Figure 7A:
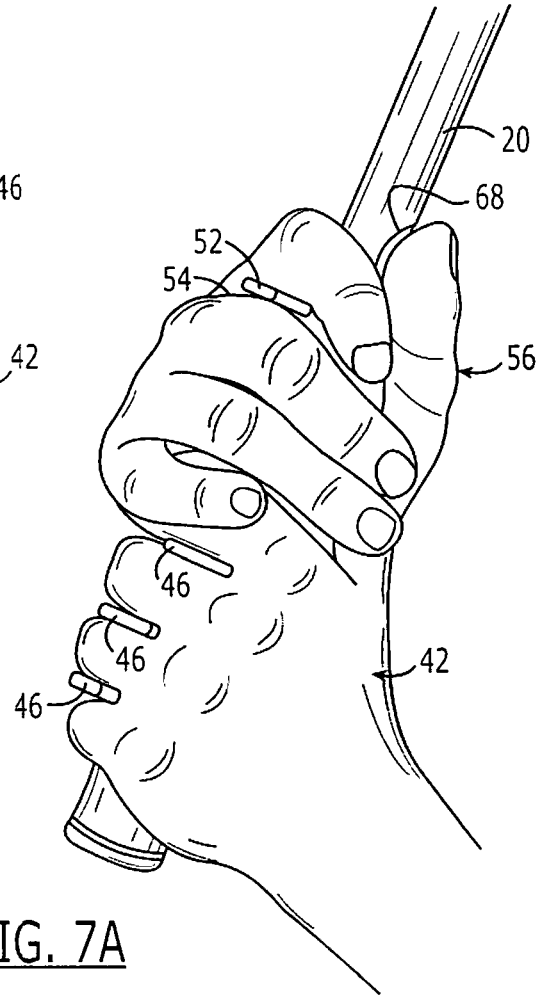
FIG. 7A is a perspective view of an overlapping styled gripping of the grip of FIG. 5 illustrating top and bottom finger webs biased against protrusions carried by the grip.

With reference to FIGS. 2, 2A, and 3, one embodiment of the grip 20, herein described by way of example, includes a plurality of protrusions 36 that extend outwardly from a longitudinal axis 38 of the grip and are arranged for receiving multiple finger webs 40 biased against them in guiding a hand 42 of the user 44, as illustrated with reference to FIGS. 4-6, for gripping the shaft 12 proximal end portion 14, earlier described with reference to FIG. 1. In one embodiment, the grip 20 may comprise three protrusions 46 for receiving the hand 42 that for a right-handed golfer will be the top hand on the shaft 12 positioned at a proximal portion 20P of the grip, as illustrated by way of example with reference to FIG. 7. The three protrusions 46 extend from a first side 48 of the grip 20 for receiving three webs 40 between four fingers of the top hand. With reference again to FIGS. 2, 2A, and 3, and to FIGS. 7 and 7A, another protrusion 52 for receiving a web 54 between fingers of the bottom hand 56 of the user 44 along a distal portion 20D of the grip 20. In one desired arrangement, and as illustrated with reference to FIG. 8, the longitudinal axis 38 of the grip 20 (coincident with the axis of the shaft 12) and an a centerline 58 through a palm of the top hand 42 form approximately a forty five degree angle 60. As further illustrated with reference again to FIG. 5, the protrusions 46 are aligned such that a line 47 extending through the protrusions along common points 46*a*, 46*b*, and 46*c* on each of the protrusions 46 forms a non-zero angle 47A with the longitudinal axis 38. Each protrusion 46A, 46B, 46C of the protrusions 46 is thus offset from an adjacent one protrusion along a circumference of the grip 20.

With reference again to FIGS. 2-4, a fourth protrusion 62 extends from a second side 64 radially offset from the first side 48 for receiving a thumb 66 of the top hand 42, as illustrated with reference again to FIG. 5, by way of example. Further, an indentation 68 is provided on the second side 64 for receiving a thumb of the bottom hand 56. A second indentation 69 is also provided on the grip second side 64 for use by the thumb of the top hand 52 while the thumb is biased against the protrusion 62.

With reference again to FIG. 1, the couplings 22, 24 and the sliding elements 30, 32 may have various embodiments within teachings of the present invention. By way of example, and with reference to FIGS. 9-11, the couplings 22, 24 and the sliding elements 30, 32 may be magnetically coupled with both being magnetized, one having a magnet and the other metallic, or the like. For the embodiment herein described by way of example, the sliding element comprises a plastic body 70 with a metallic ring 72 on a coupling side of the element. The sliding elements 30, 32 may be modified in weight by adding ballast material to the plastic body, by way of example, or by selecting a desired weighted element. The couplings 22, 24 are magnetized for the embodiment herein described. Alternatively, and as will come to those of skill in the art now having the benefit of the teachings of the present invention, friction or latching connections 25 may be used, such as an adhesive or Velcro, illustrated with reference again to FIG. 11. By way of example for the embodiment herein described for the gold training device 10, a first coupling force between the first coupling 22 and the first sliding element 30 is less than a second coupling force between the second coupling 24 and the second sliding element 32, thus less centrifugal force is required for releasing the first sliding element than for releasing the second sliding element.

Figure 9:
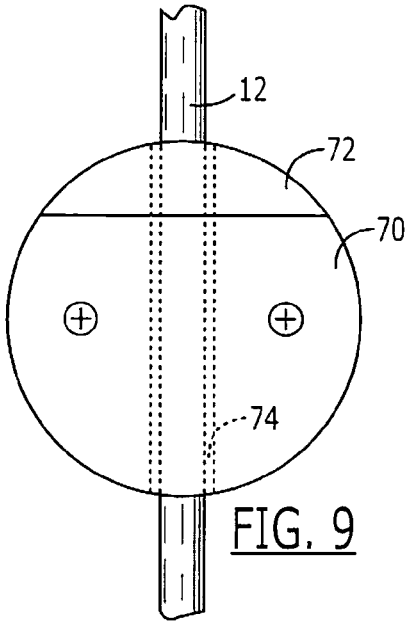
FIG. 9 is a partial plan view of one embodiment of a sliding element operable with a shaft.
Figure 11:
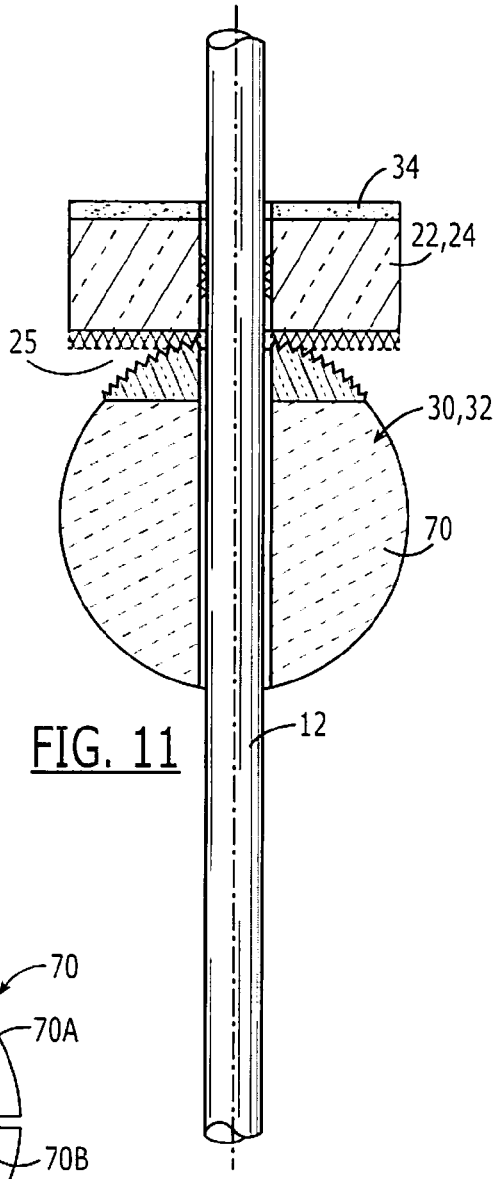
FIG. 11 is a partial cross section view illustrating a coupling and sliding element of FIG. 1.
Figure 10:
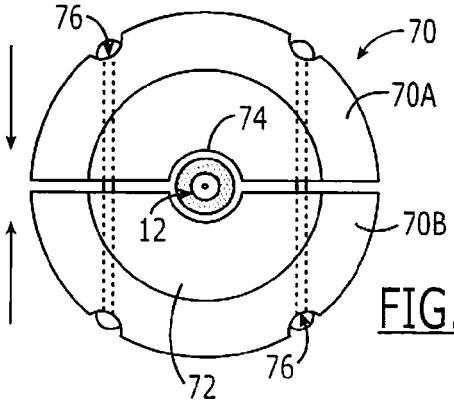
FIG. 10 is an end view of the embodiment of FIG. 9 illustrating a biasing of element portions against the shaft for selecting a friction contact therewith.

With continued reference to FIGS. 9-11, for the embodiment herein described, the first and second sliding elements 30, 32 comprise the body 70 having a bore 74 extending therethrough and dimensioned for sliding along the shaft 12. It may be desirable to modify the friction between the first and second sliding elements 30, 32 and the shaft 12. One embodiment for modifying the frictional force may include having each sliding element 30, 32 formed from two parts 70A, 70B and having the shaft 12 slidably received therebetween. By compressing the shaft 12 between the two parts 70A, 70B using connecting screws 76, a desired sliding friction between the sliding elements and the shaft is achieved. As a result and by way of example when simulating a golfing swing, the releasing of the sliding elements and the sliding along the shaft may be modified to accommodate a desired circumstance or user characteristic. The coupling forces between the first coupling and the first sliding element and between the second coupling and the second sliding element may be preset for a desired swinging movement.

Yet further with regard to training a swing, and with reference again to FIG. 1, an alignment element 78 may be carried by the shaft 12, which element may have a shape of a golf club head for the golf training device 10 herein described by way of example. In addition, a rod 80 may be carried within the shaft and longitudinally extendable from the proximal end portion 14 for viewing by the user during a swinging movement for identifying a swing plane therefor, desirable in one training exercise for a golf swing.

Figure 12:
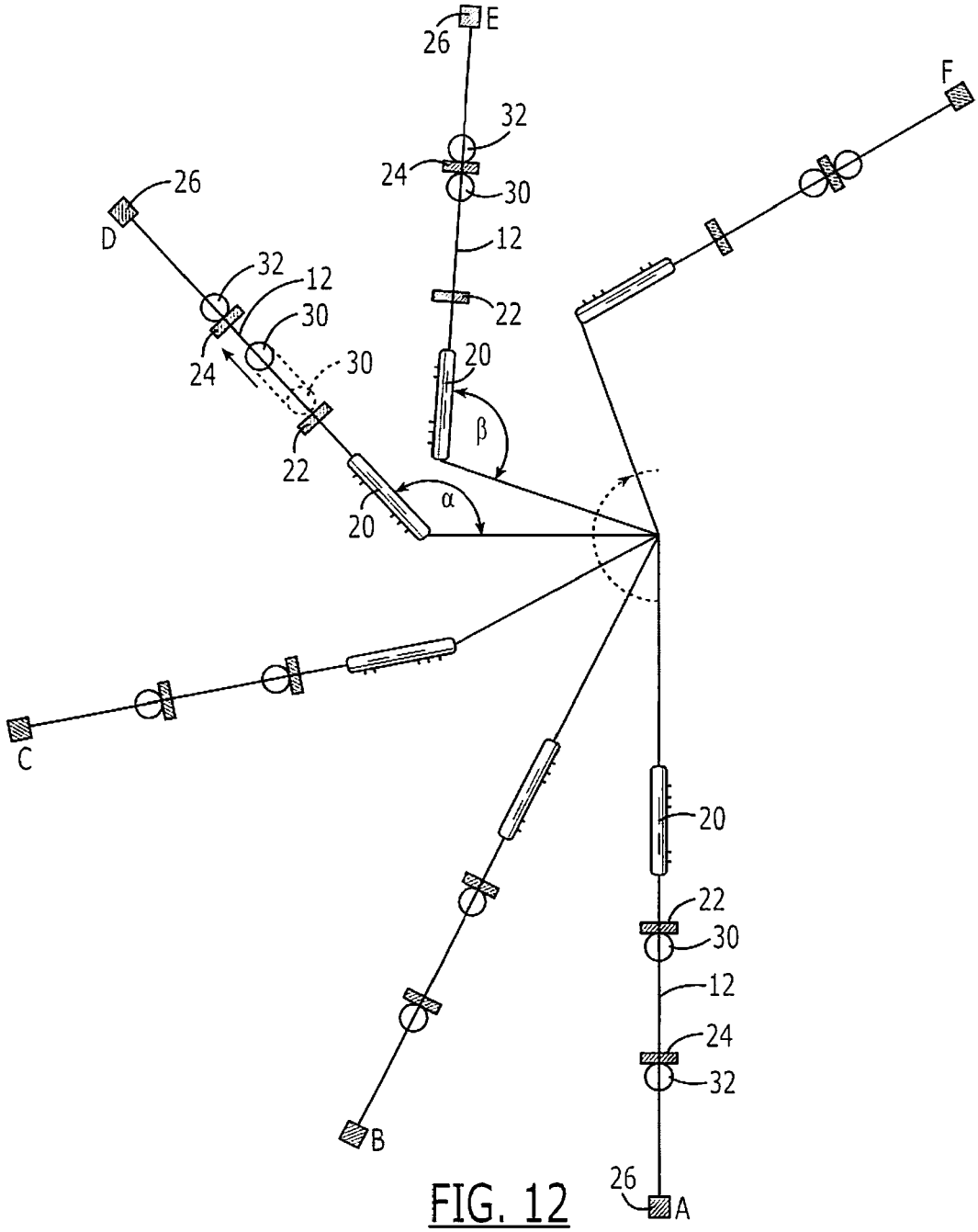
FIG. 12 is a diagrammatic view of a golfing backswing using the embodiment of FIG. 1.
Figure 13:
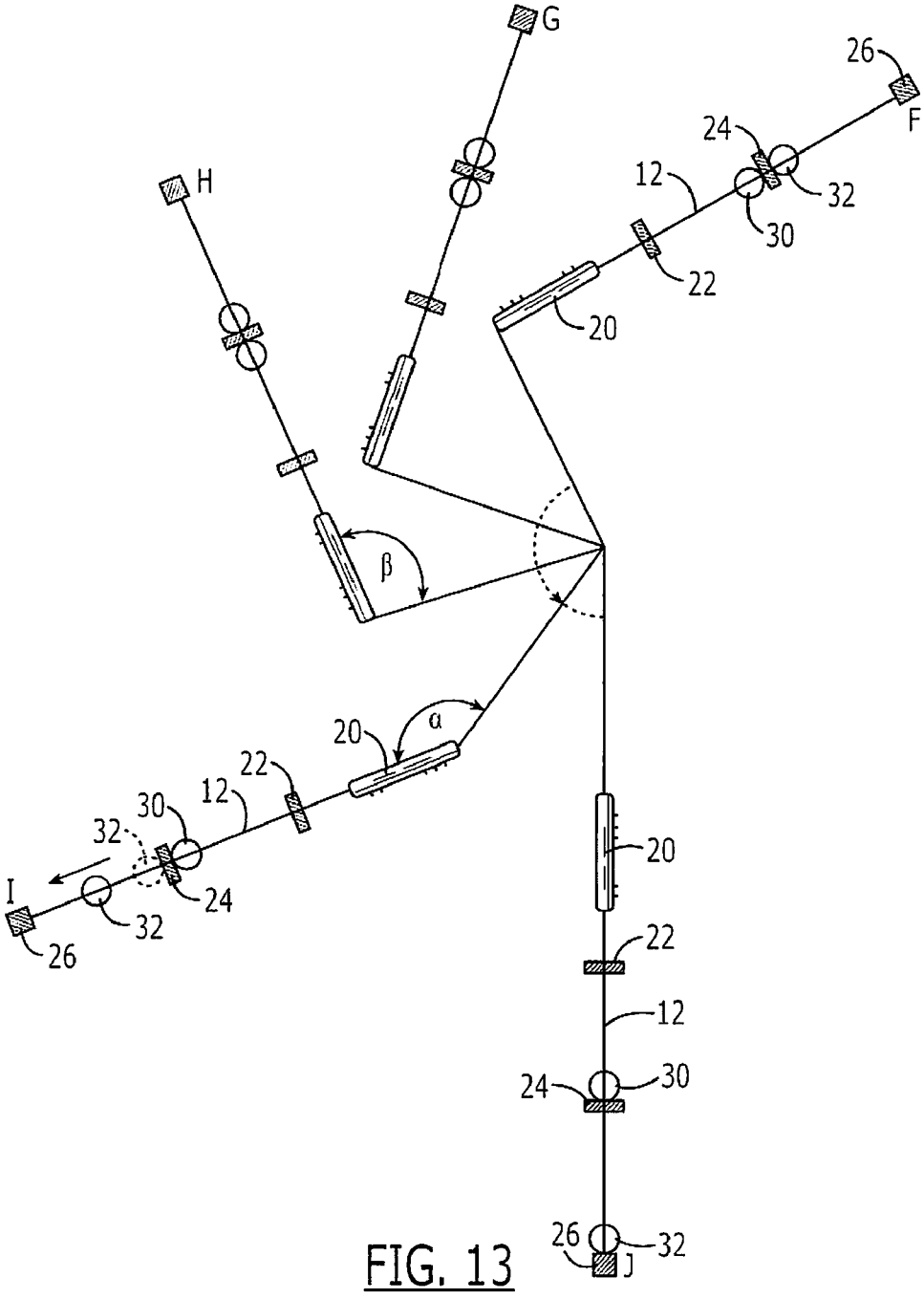
FIG. 13 is a diagrammatic view of a golfing downswing using the embodiment of FIG. 1.

By way of example, one method of use may include the training of a full golf swing. With reference now to FIGS. 12 and 13, during one desired swing, two impact or percussion sounds will be heard. With reference to FIG. 12 and to swing locations points A-F, the first sound is heard during the backswing at point E in the backswing as the first sliding element 30 contacts the second coupling 24. In order for the user to hear the noise associated with the backswing (the first sound), the user will need to "set" the club properly. For the example herein described, the first sliding element 30 will begin to leave the first coupling 22 near swing point D. This may require a cocking of the wrists and a slight increase in tempo during the backswing, illustrated by way of example with reference to angles $\alpha$ and $\beta$ for swing points D and E, respectively.

With reference again to FIG. 13, the second impact sound is desirably heard at point J. This is created when a desired tempo is used. By way of example, imagine a cracking of a whip. This allows the second sliding element 32 to be released from the second coupling 24, as illustrated at about point I, to slide down the shaft 12 and hit the stop 26. Typically, an un-cocking of the wrists as illustrated with angles $\beta$ to $\alpha$ in the downswing will cause a desired release of the second sliding element 32. The desired setting of the club going back and the desired releasing, or un-cocking, on the downswing provides a desirable maximum club head acceleration. As earlier described with reference to FIGS. 9-11, not every golfer swings with the same speed or force. With this in mind, the first and second slidable elements 30, 32 will be adjustable so that the beginner, as well as the seasoned professional will be allowed to train using the device 10. By way of example for one embodiment herein describe, the first sliding element 30 may require less centrifugal force to allow it to break free from its starting position. The second sliding element 32 may be set to require significantly more centrifugal force to be applied during the downswing to allow it to break free and contact the stop 26 at the end of the shaft 12.

Figure 14:
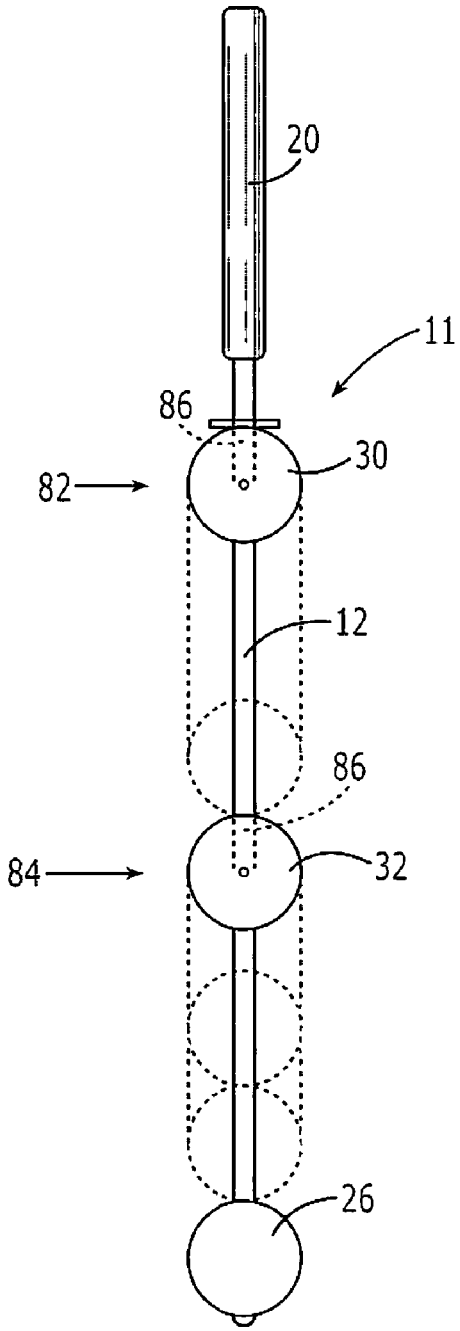
FIG. 14 is a plan view of an alternate embodiment of a swing training device.
Figure 16:
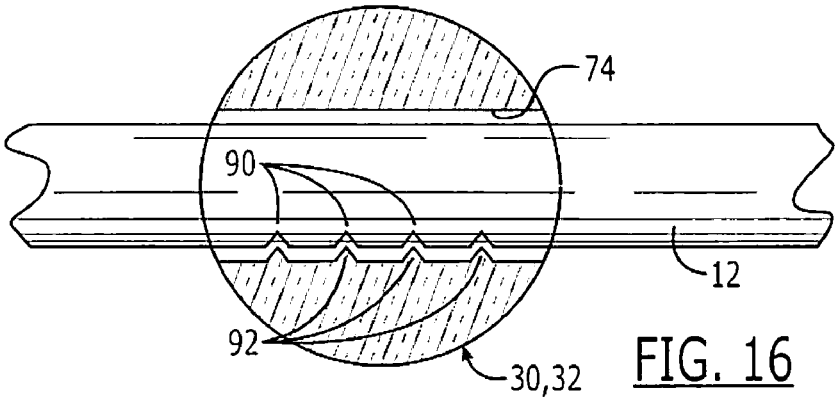
Figure 17:
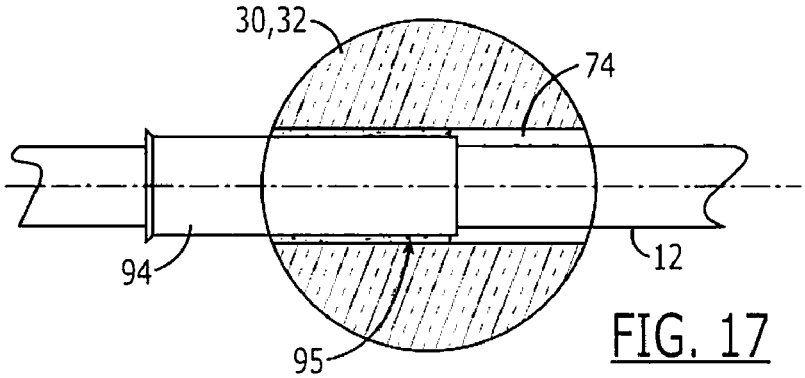
Figure 18:
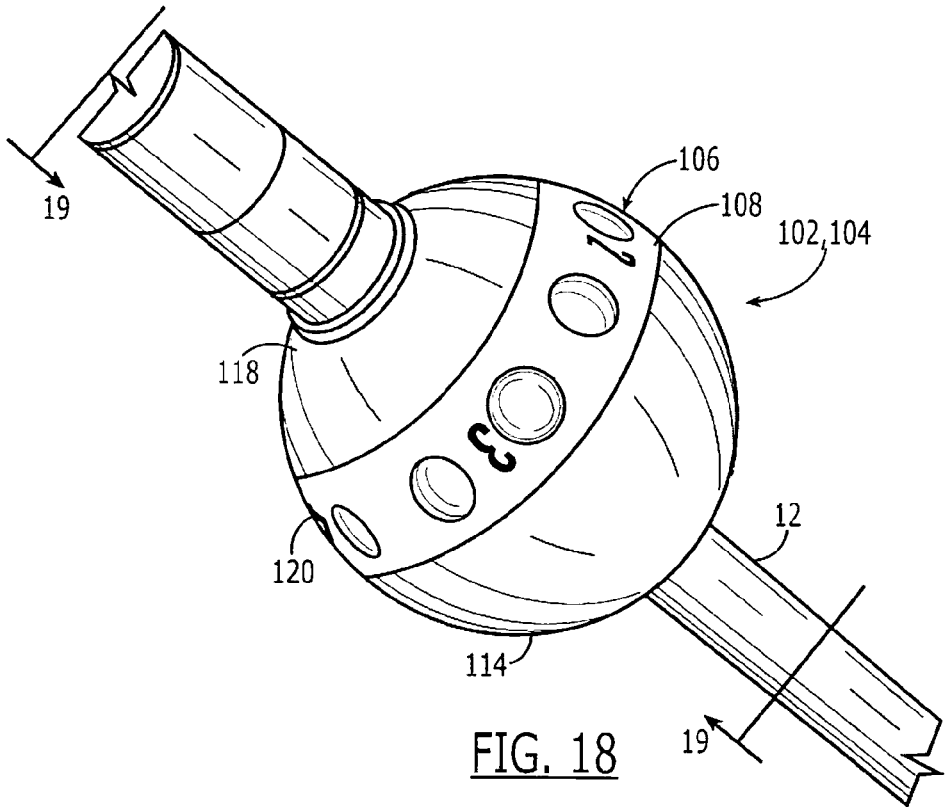
FIG. 18 is a partial perspective view illustrating an improved embodiment of sliding elements operable with embodiments of the present invention.
Figure 19:
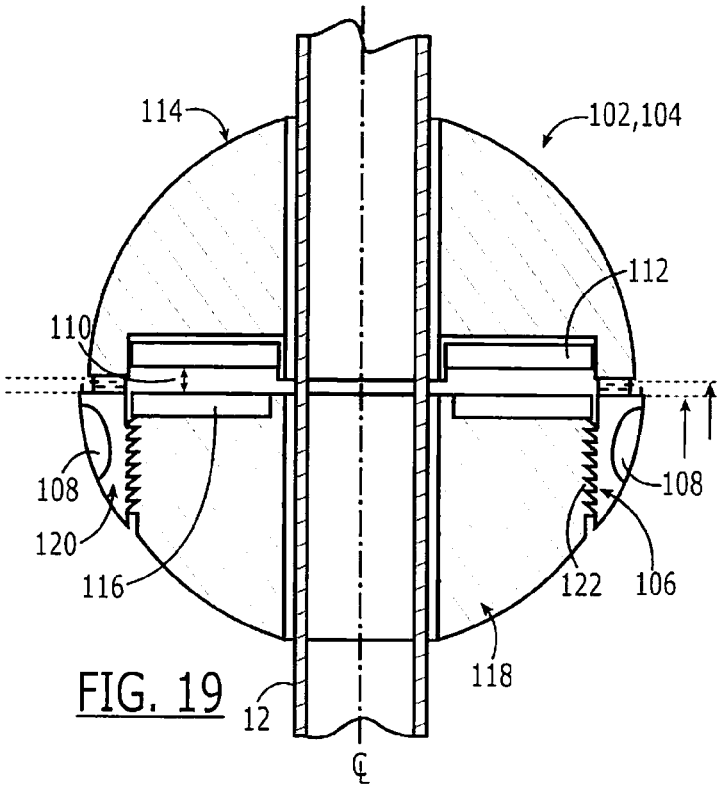
FIG. 19 is a cross-sectional view taken through lines 19-19 of FIG. 18.
Figure 20:
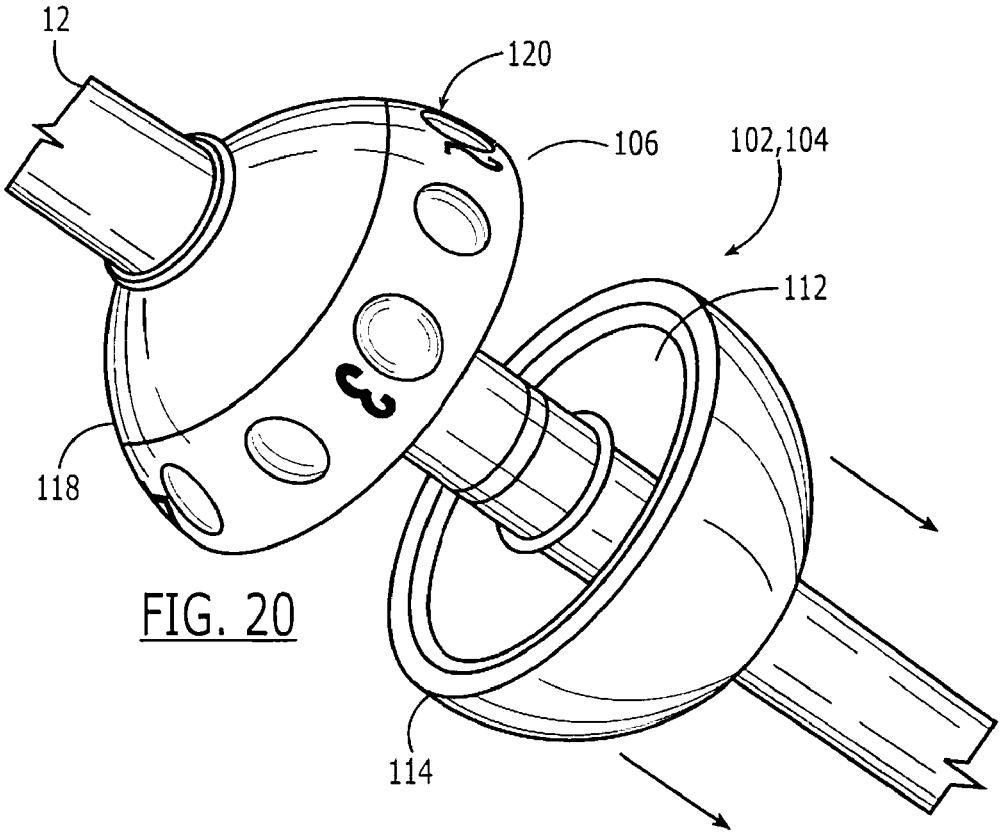
FIGS. 20 and 21 are top and bottom perspective views, respectively, of the embodiment of FIG. 18 illustrating a separation of a sliding element from a fixed element, by way of example.
Figure 21:
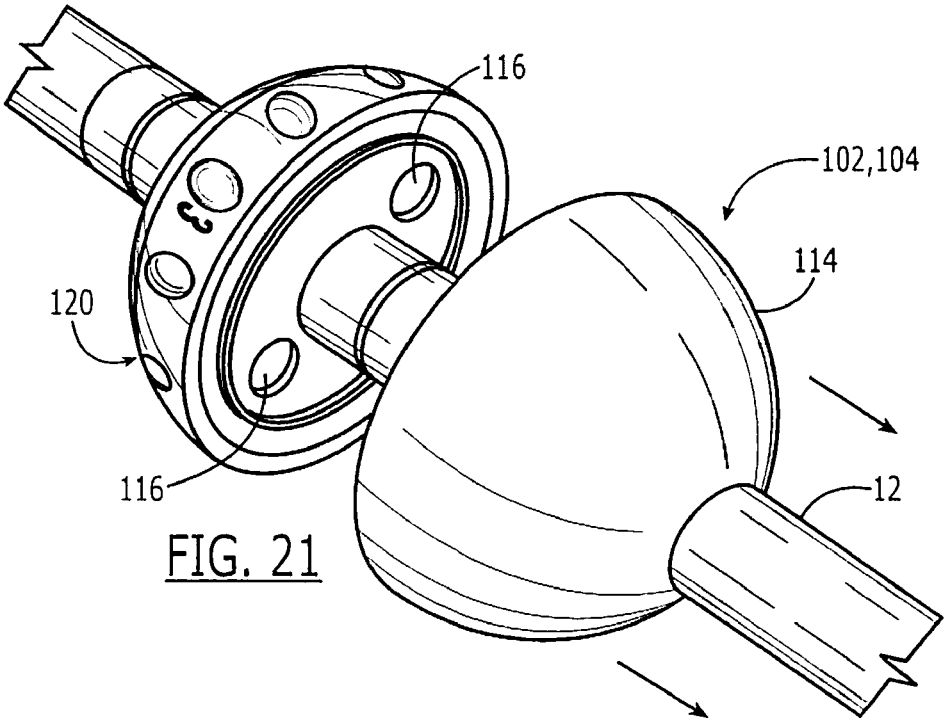

As illustrated with reference to FIG. 14, an alternate embodiment of the device 10, identified as device 11 may include a tapered golf shaft 12 and the two sliding elements 30, 32 to move freely after they have been released from their respective starting positions 82, 84. As above described with reference to FIG. 1, the stop 26 is carried at the shaft distal end 14 opposite the grip 20. The stop 26 prevents the first and second sliding elements 30, 32 from coming loose from the shaft 12 and provides a distinct sound at the time of the second impact portion of the swing creating the sound made during the downswing. The second sliding element 32 stops the first sliding element 30 when the user makes the desired back-swing. The first sound is made when the first element 30 hits the second element 32 during the backswing. A release mechanism 86 (a friction barrier by way of example) described with reference to FIGS. 15-17 holds the first sliding element 30 in place during the completion of the backswing and releases both the first and second slidable elements for moving toward the stop 26 when sufficient force is applied during the downswing.

Figure 15:
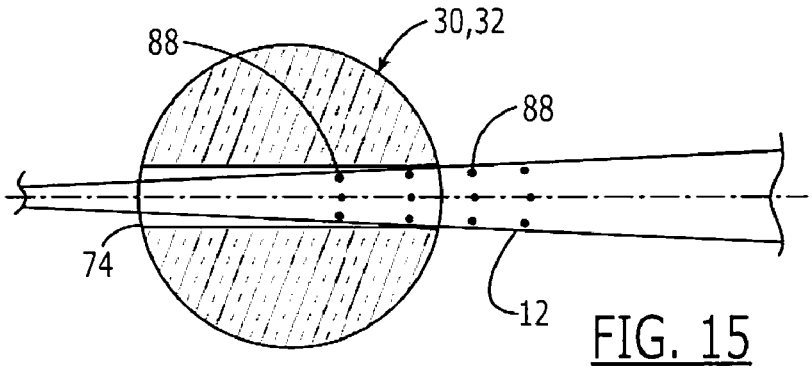
FIGS. 15, 16, and 17 are partial cross section views of alternate embodiments of sliding elements operable with a shaft for providing coupling and release mechanisms operable with embodiments of the present invention.

As illustrated by way of example with reference to FIG. 15, one embodiment may include the sliding element 30, 32 having the bore 74 forced into a taper of the tapered shaft 12 varying the frictional contact by pushing the element to a first, second, third indicator mark 88 made on the shaft. As illustrated with reference to FIG. 16, notches 90 and tabs 92 may be carried by the shaft 12, whether tapered or not, and by the surface of the bore 74, with a degree of releasing force countering a centrifugal force based on the number of notches engaged. Yet further, a friction sleeve 94 may be employed for establishing a preset frictional contact 95 between the element 30, 32 and the shaft 12, as illustrated by way of example with reference to FIG. 17.

Figure 1A:
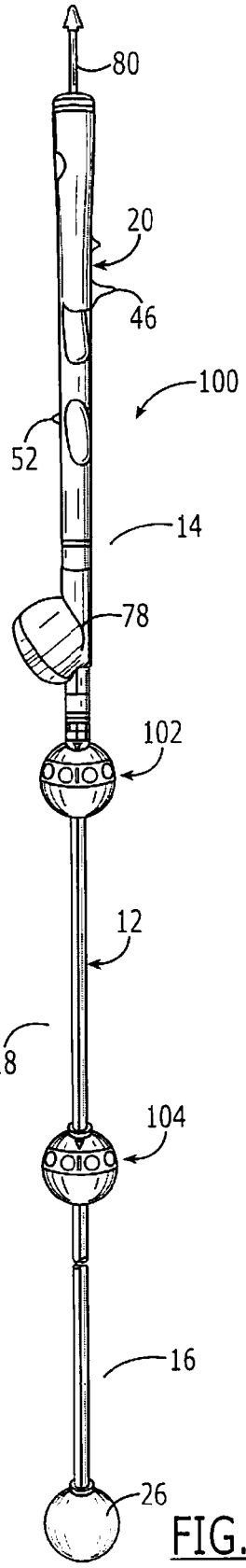

As above described, the golf swing training device 10 includes features used to train a golfer to build and maintain a powerful, repeating golf swing. Three sensory systems are developed to improve the golf swing, and include visual, auditory, and kinesthetic. As now appreciated by those of skill in the art, a golfer being trained will see, hear, and feel a desired golf swing. For one improvement of the device 100 herein described by way of example with reference to FIG. 1A, the device is 36 inches long and weighs approximately 20 ounces, roughly 50 percent more weight than an average five iron, which is helpful in training for a feel in the golf swing. As illustrated with reference earlier to FIG. 1 and now to FIG. 1A, the device 100 includes the form molded grip 20, the pointer rod 80, and the club face as the alignment element 78. The first and second couplings 22, 24 and the first and second sliding elements 30, 32 are now described as firs and second magnetic elements 102 and 104, respectively.

As for earlier described embodiments, the first and second magnetic elements 102, 104 promote a correct wrist setting or cocking of the wrists on the backswing and a proper timed release of the golf club at impact, as earlier described. Reference is now made to FIGS. 18-21, wherein each magnetic element 102, 104 may include five resistance settings 106, as desired, including indexed settings 108 on each element to accommodate differences in a players' physical strength and also swing tempo. The settings 106 may be continuous between each setting as desired. For the embodiment herein described by way of example, Setting 1 has the least magnetic resistance while Setting 5 is the strongest setting with the most magnetic resistance. With specific reference to FIG. 19, Setting 1 will have a greater gap 110 between a metal plate 112 of the slidable portion 114 and the magnet 116 carried in the fixed portion 118 of the elements 102. 104. Rotating an adjustment member 120, herein described as a ring, along the threaded connection 122 of the fixed portion 118 modifies the gap 110 by allowing the ring 120 to be biased against the opposing slidable portion 114. As will come to the mind of those skilled in the art, the slidable portion and the fixed portion may be interchanged with regard to that portion that carries the adjustable ring, metal plate, and the magnet.

With reference again to FIG. 1A, and for the embodiment herein described, the upper element, herein referred to as the first magnetic element 102 is involved in setting the wrists on the back-swing (and finding the right tempo to do so) and will typically have less magnetic force overall than does the lower ball to account for the slower swing speed of the backswing. The lower element, herein referred to as the second magnetic element 104, may have stronger magnets in order to accommodate the extra speed on the downswing. One objective of the golfer training his swing may be to eventually be able to snap the bottom element 104 at the highest resistance, Setting 5. A tip to find your natural tempo is to swing ones own 5-iron smoothly a few times, then pick up the training device and make a similar swing. One approach includes putting the top ball, the first sliding element 30 on resistance level Setting 1 to start and the lower ball, the second sliding element 32 on Setting 2 or Setting 3, with adjustments then made from there.

Figure 22:
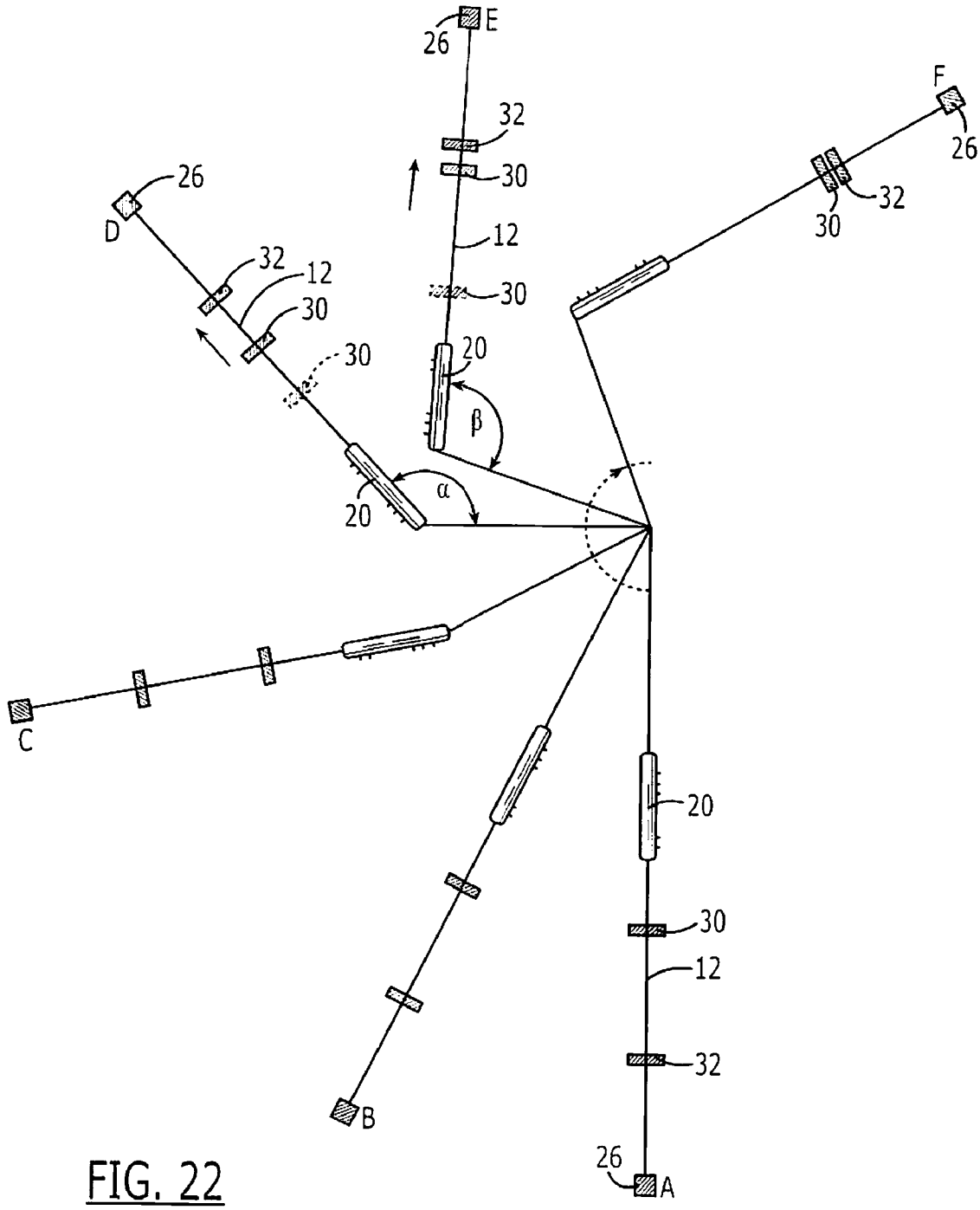
FIG. 22 is a diagrammatic view of a golfing backswing using the embodiment of FIG. 14.
Figure 23:
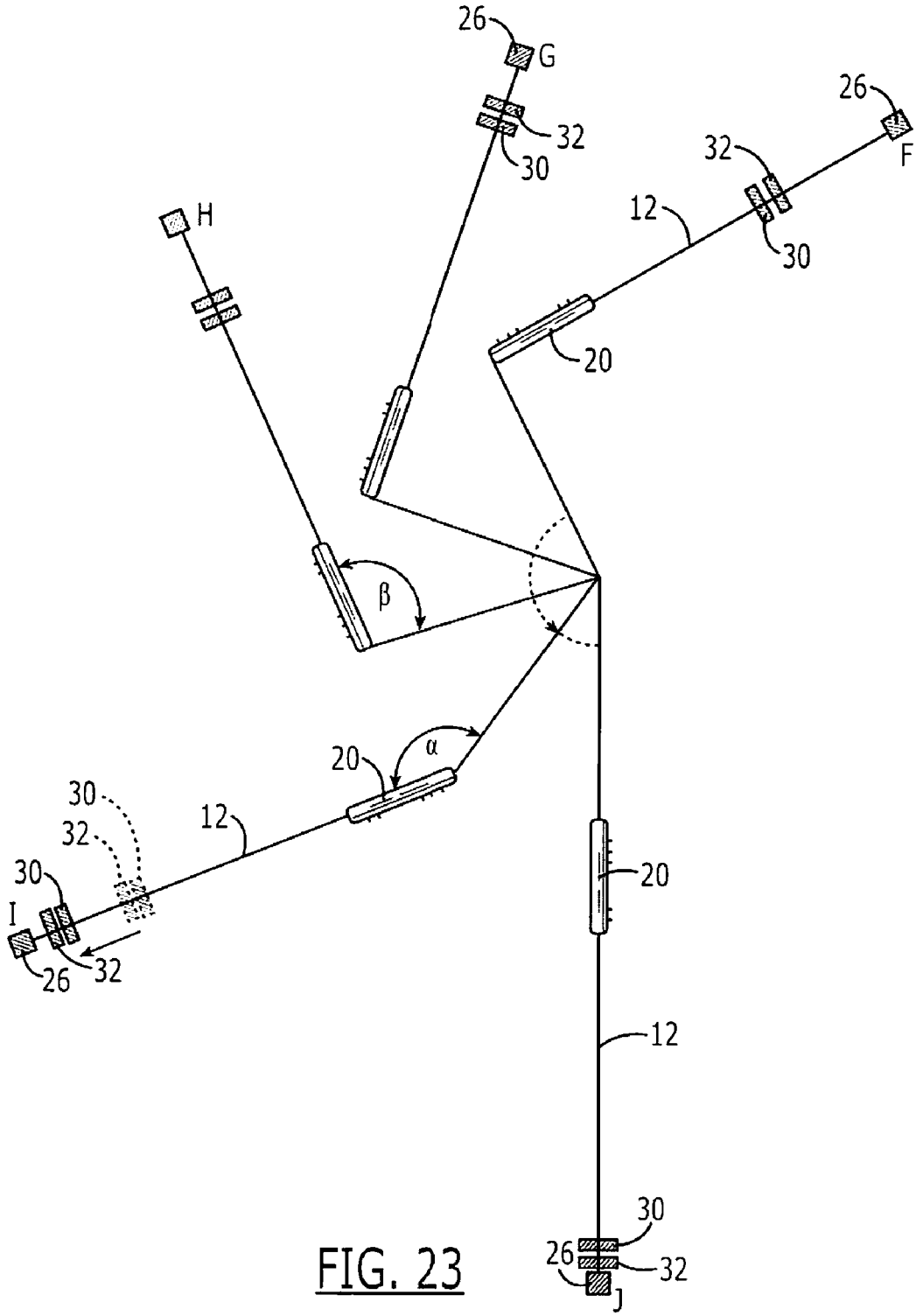
FIG. 23 is a diagrammatic view of a golfing downswing using the embodiment of FIG. 14.

As earlier described, during a desired swing, two impact or percussion sounds are heard. With reference to FIG. 22, the first sound is heard during the backswing at point E. In order for the user to hear the noise associated with the backswing (the first sound), the user will need to "set" the club properly. This may require a cocking of the wrists and a slight increase in tempo during the backswing, by way of example. The second impact sound is heard at point J as illustrated with reference to FIG. 23. The sliding elements 30, 32 slide down the shaft 12 together and hit the stop 26. This will be when the wrists un-cock in the downswing. The desired setting of the club going back and the desired releasing, or un-cocking, on the downswing permits achieving maximum club head acceleration. As above described, not every golfer swings with the same speed or force. Therefore, frictional contact of the first and second sliding elements 30, 32 with the shaft 12 may be adjustable so that the beginner, or the elements 102, 104 as well as the seasoned professional will be allowed to practice with this device.

By way of example with regard to operating the training device 100, swing the device at a normal tempo and get the slidable portion 114 of the first magnetic element 102 to release on the back-swing by the time you are halfway back. This is where your left arm is parallel to the ground. Extend the plane pointer 80 prior to swinging, and check to see that at the halfway back position the plane pointer is aimed down to the ground at a point just outside your toes inside the target line. It is possible with a violent back-swing that you could snap both elements 102, 104 as you approach the top of the swing, but this is not a desirable technique. The slidable portion 114 of the first element 102 must snap prior to reaching the half way back slot—check the position and hold it for a couple of seconds allowing the magnetic ball to reset and you are ready to swing again. A late snap of the ball near the top of the backswing should be avoided. It results in many swing errors—poor wrist cock, over-swinging, no power, being off plane, and the like. Swinging back smoothly and setting the wrist angle properly is the key to leverage and solid contact. If you are snapping the ball late or not it is possible that there may need to be more of an aggressive setting of the wrists, made easier by a good grip, which you will now have.

Your tempo may have to be sped up to accomplish the snapping on the back-swing as some people, swing back too slowly.

General guidelines are herein presented in Table 1, by way of example, for setting the initial resistance levels, Settings 106 on the training device 100.

TABLE 1

| | Upper Ball Setting | Lower Ball Setting |
|---|---|---|
| Ladies, seniors, juniors, beginners<br>Current Distance: 7 iron ± 100 yards;<br>driver ± 200 yards | 1 or 2 | 1 or 2 |
| Amateurs - slicers with smooth swings<br>Current Distance: 7 iron ± 130 yards;<br>driver ± 240 yards | 1, 2, 3 | 2 or 3 |
| Aggressive swingers, low handicaps<br>Current Distance: 7 iron, 150 yards+; driver,<br>260 yards+ | 3 or 4 | 4 or 5 |
| Physically strong with high swing speed<br>Current Distance: 7 iron ± 170 yards,<br>driver ± 280 yards | 3, 4, 5 | 5 |
| Slow tempo, good player, high swing speed<br>Current Distance: 7 iron 1160 yards;<br>driver ± 270 yards | 2 or 3 | 4 or 5 |

By way of further example, if it is difficult to get the slidable element of the first magnetic element to snap just prior to halfway back or the lower magnetic ball snapping in the impact area, reduce the resistance setting one level at a time until you achieve the desired result. If there is no snap on the backswing and both slidable elements snap on the downswing, reduce the tension on the upper element, and/or try to increase the speed of your swing tempo on the backswing emphasizing the movement of the stomach muscles and the setting of the wrists. If both upper and lower elements snap in the backswing, increase the tension on the lower ball and slow your swing tempo.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. A swing training apparatus comprising:

an elongate shaft having a proximal portion, an opposing distal portion, and an intermediate portion therebetween; and first and second elements carried at the proximal and the intermediate portions, respectively, each of the first and second elements having a fixed portion fixedly attached to the elongate shaft, a slidable portion for sliding movement along the shaft, and a preset magnetic attraction therebetween, wherein the sliding portion is magnetically coupled to the fixed portion prior to a swinging of the shaft and released therefrom by a centrifugal force exerted on the sliding portion during a swinging motion of the shaft, wherein each of the first and second elements includes:

at least one of the fixed and slidable portions having a magnetic portion;

at least one of the fixed and slidable portions having a metallic portion operable with the magnetic portion; and an adjustment member carried by at least one of the fixed and slidable portions, the adjustment member establishing a separation distance between the magnetic and metallic portions, thus providing the preset magnetic attraction.

2. An apparatus according to claim 1, wherein the magnetic portion comprises a magnet, and wherein the metallic portion comprises a metallic plate.

3. An apparatus according to claim 1, wherein each of the first and second elements comprises a spherical shape, and wherein the adjustment member comprises a ring extending about perimeters of the first and second portions, the adjustment member having threading engagement with the fixed portion, and wherein rotation of the adjustment member modifies the separation distance between the fixed and slidable portions, thus modifying the preset magnetic attraction therebetween.

4. An apparatus according to claim 3, wherein the adjustment ring comprises a plurality of indexed settings.

5. An apparatus according to claim 3, wherein each of the fixed a\d slidable portions comprises a hemispherical shape.

6. An apparatus according to claim 1, wherein the metallic plate comprises a metal ring having an aperture therein receiving the shaft therethrough.

7. An apparatus according to claim 1, further comprising a stop affixed to the distal portion of the shaft.

8. An apparatus according to claim 7, wherein the stop receives the sliding element from the second element, and wherein the fixed portion of the second element forms a stop for receiving the sliding portion of the first element.

9. A swing training apparatus comprising:

a shaft having a proximal portion and an opposing distal portion;

an element carried on an outside surface of the shaft between the proximal and distal portions, the element having a fixed portion fixedly attached to the elongate shaft and a slidable portion for sliding movement along the outside surface of the shaft, wherein the sliding portion is magnetically coupled to the fixed portion through a preset magnetic attraction, wherein the element includes at least one of the fixed and slidable portions having at least one of a magnetic portion and a metallic portion operable with the magnetic portion:

an adjustment member carried by at least one of the fixed and slidable portions, the adjustment member establishing a separation distance between the magnetic and metallic portions, thus providing the preset magnetic attraction; and a stop fixedly attached at the distal portion of the shaft, wherein a centrifugal force exerted on the sliding portion during a swinging motion of the shaft results in the sliding portion moving along the outside surface toward the stop.

10. An apparatus according to claim 9, wherein the magnetic portion comprises a magnet, and wherein the metallic portion comprises a metallic plate.

11. An apparatus according to claim 9, wherein each of the first and second elements comprises a spherical shape, and wherein the adjustment member comprises a ring extending about perimeters of the first and second portions, the adjustment member having threading engagement with the fixed portion, and wherein rotation of the adjustment member modifies the separation distance between the fixed and slidable portions, thus modifying the preset magnetic attraction therebetween.

12. An apparatus according to claim 11, wherein the adjustment member comprises a plurality of indexed settings.

13. An apparatus according to claim 11. wherein each of the fixed a\d slidable portions comprises a hemispherical shape.

14. An apparatus according to claim 9, wherein the metallic plate comprises a metal ring having an aperture therein receiving the shaft therethrough.

15. A swing training apparatus comprising:

a shaft having a proximal portion and an opposing distal portion:

a first element carried on an outside surface of the shaft between the proximal and distal portions, the first element having a fixed portion fixedly attached to the elongate shaft and a slidable portion for sliding movement along the outside surface of the shaft, wherein the sliding portion is magnetically coupled to the fixed portion through a first preset magnetic attraction;

a second element carried on an outside surface of the shaft between the first element and the shaft distal portion. the second element having a fixed portion fixedly attached to the elongate shaft and a slidable portion for sliding movement along the outside surface of the shaft, wherein the sliding portion is magnetically coupled to the fixed portion through a second preset magnetic attraction; and each of the first and second elements having an adjustment member carried by at least one of the fixed and slidable portions, the adjustment member establishing a separation distance therebetween for providing the first and second preset magnetic attractions, respectively.

16. An apparatus according to claim 15, further comprising a stop fixedly attached at the distal portion of the shaft, wherein a centrifugal force exerted on each of the sliding portions for the first and second elements during a swinging motion of the shaft results in the sliding portion moving along the outside surface toward the stop.

17. An apparatus according to claim 15, wherein each of the first and second elements includes at least one of the fixed and slidable portions having at least one of a magnetic portion and a metallic portion operable with the magnetic portion.

18. An apparatus according to claim 15, wherein each of the first and second elements comprises a spherical shape, and wherein the adjustment member comprises a ring extending about perimeters of the first and second portions, the adjustment member having threading engagement with the fixed portion, and wherein rotation of the adjustment member modifies the separation distance between the fixed and slidable portions, thus modifying the preset magnetic attraction therebetween.

19. An apparatus according to claim 18, wherein the adjustment member comprises a plurality of indexed settings.

* * * * *